United States Patent [19]

Kulpa

[11] 4,190,065

[45] Feb. 26, 1980

[54] EXOTHERMIC HAIR CURLER

[75] Inventor: Walter J. Kulpa, Norwalk, Conn.

[73] Assignee: Remington Products, Inc., Bridgeport, Conn.

[21] Appl. No.: 825,638

[22] Filed: Aug. 18, 1977

[51] Int. Cl.[2] ..... A45D 2/12

[52] U.S. Cl. ..... 132/33 R

[58] Field of Search ..... 132/33, 36.2

[56] References Cited

U.S. PATENT DOCUMENTS

| | | | |
|---|---|---|---|
| 2,160,744 | 5/1939 | Lewit | 132/36.2 R X |
| 2,369,060 | 2/1945 | Lindeen | 132/36.2 B |
| 3,465,759 | 9/1969 | Haefele | 132/36.2 R |
| 3,545,457 | 12/1970 | Schepis | 132/33 R |

*Primary Examiner*—G. E. McNeill

*Attorney, Agent, or Firm*—Charles R. Miranda; Joseph S. Failla

[57] ABSTRACT

A laminated exothermic hair curler is described having a first sheet formed of a liquid impervious material which includes a plurality of apertures and a second non-perforated sheet of liquid impervious material which is sealed in assembly with said first sheet and provides an enclosure into which an activating fluid can enter through apertues in the first sheet. A liquid absorbent sheet is positioned within the enclosure adjacent the first sheet and chemically reactive means for generating an exothermic reaction are positioned between the absorbent sheet and the second laminate sheet. This laminate assembly is formed into an elongated curler body having an arc-shaped cross sectional configuration.

30 Claims, 9 Drawing Figures

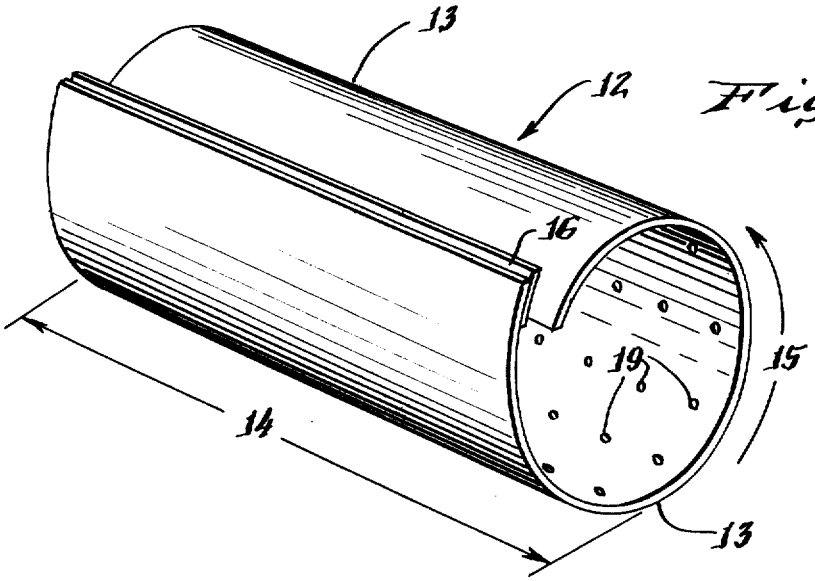
Fig. 1.
Fig. 2.
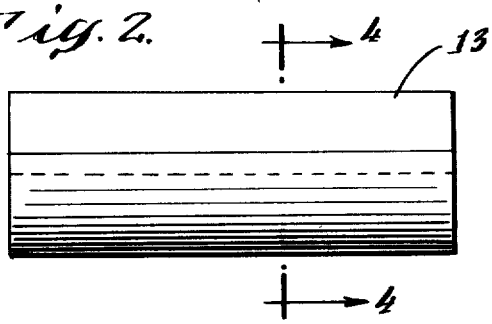
Fig. 3.
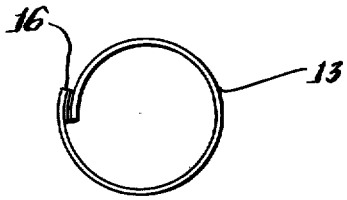
Fig. 4.
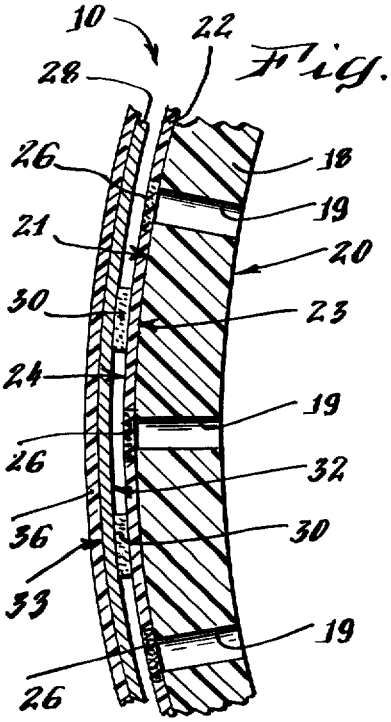
Fig. 5.
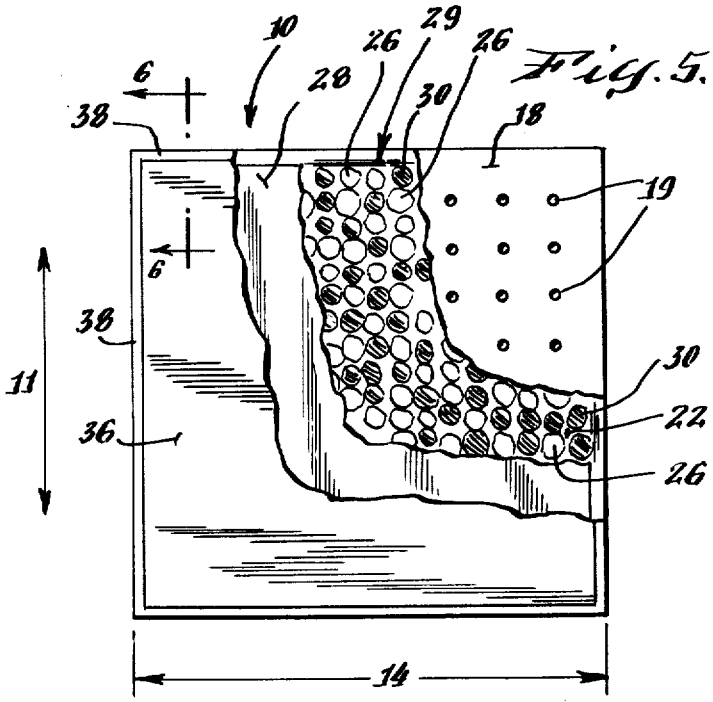

EXOTHERMIC HAIR CURLER

BACKGROUND OF THE INVENTION

This invention relates to hair curlers and more particularly to hair curlers of the self-heating type.

Hair curlers which are self-heating and which are adapted to wind a curl of hair on a body thereof are known in the art. Self-heating is provided by combining substances to generate an exothermic chemical reaction wherein warming heat is generated for hair treatment. The exothermic reaction is generally activated by moistening the reacting substances, as for example by dispensing a limited amount of water on the curler body. The hair is then curled onto the body and is heated by the progressing exothermic chemical reaction.

Prior self-heating hair curlers of the type described exhibit several disadvantages. In particular, the chemical substances have been positioned within a packet and apertures are formed within the packet both for the ingress of a moistening fluid which initiates the reaction and to permit the progressing reaction to "breathe" by permitting air with its oxygen content to flow into the packet. A chemical reaction which takes place results in a residue of relatively small flake-like particles and these particles have exhibited a tendency to escape from the packet through the apertures during use or when the curler is removed from the hair and have undesirably resulted in dispersing these particles about the hair or the head.

The exothermic chemical reaction requires a measured amount of moisturizing fluid for initiating reaction. Too great or too small a quantity of fluid will result in a reaction which progresses at an undesired rate or at undesired heat level. In order to control the rate of reaction, it has been necessary to carefully dispense the amount of moisturizing fluid. Since a large number of hair curlers can be used in any one hair setting, this of course imposes a substantial burden on the user and detracts from the overall self-heating benefits of the curler.

Accordingly, it is an object of this invention to provide an improved form of exothermic hair curler.

Another object of the invention is to provide an exothermic hair curler which does not require careful dispensing of the activating fluid.

Another object of the invention is to provide an exothermic hair curler arranged to inhibit the escape of chemical residue therefrom.

SUMMARY OF THE INVENTION

In accordance with features of this invention, an exothermic hair curler is provided which comprises a laminated hair curler assembly having a first sheet formed of a liquid impervious material and including a plurality of apertures formed in a thickness thereof. A second non-perforated liquid impervious sheet is provided and is sealed in assembly with the first sheet to provide an enclosure into which an activating fluid can enter through the apertures of the first sheet. There is positioned between these sheets a liquid absorbent sheet having a surface thereof positioned adjacent the perforated sheet. Chemically reactive means for generating an exothermic chemical reaction are positioned between the liquid absorbent sheet and the second sheet. The laminate assembly is formed into an elongated curler body having an arc-shaped cross-sectional configuration.

A chemical reaction is initiated by dipping the laminated curler body into an activating fluid. The activating fluid enters the enclosure through the apertures and saturates the absorbent sheet. This sheet is adapted to absorb a predetermined quantity of activating fluid for initiating and controlling the chemical reaction when it is saturated. Upon saturation, it forms a barrier to further fluid flow at the apertures thereby inhibiting further ingress of activating fluid and inhibits flooding. Since the chemically reactive components are positioned between this absorbent sheet and the second non perforated liquid impervious sheet, any residue of reaction components becomes entrapped between these sheets and is inhibited from escaping through the apertures in the first sheet. The hair curler is thus adapted to automatically accept a volume of water for properly activating and controlling the reaction and for inhibiting escape of chemical residue.

In accordance with other features of the invention, a hydrophobic material is deposited on the absorption sheet and provides predetermined areas for venting the enclosure for a continuing reaction.

DESCRIPTION OF THE DRAWINGS

These and other objects and features of the invention will become apparent with reference to the following specifications and to the drawings where:

FIG. 1 is a perspective view of an exothermic hair curler constructed in accordance with features of this invention;

FIG. 2 is a front elevation view of the hair curler of FIG. 1;

FIG. 3 is a side elevation view of the hair curler is FIG. 2;

FIG. 4 is an enlarged fragmentary sectional view taken along line 4—4 of FIG. 2;

FIG. 5 is a view of the hair curler of FIG. 1 prior to forming into an arc-shaped cross-sectional configuration and which is partly cut away to illustrate different laminates of the curler;

DETAILED DESCRIPTION OF THE INVENTION

Figure 6:
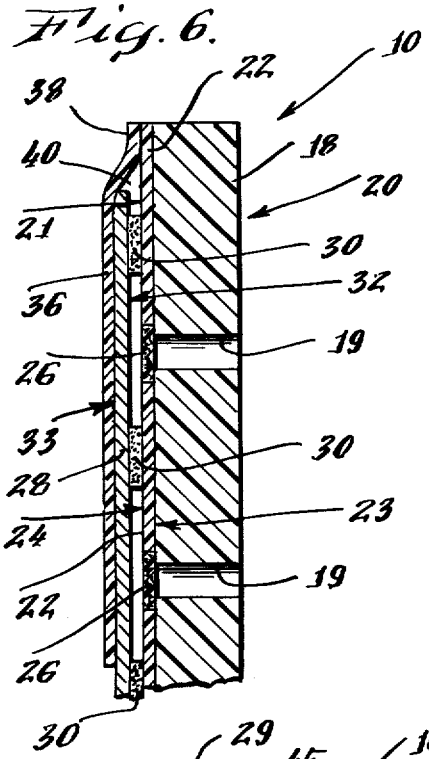
FIG. 6 is an enlarged fragmentary view taken along lines 6—6 of FIG. 5.

In a preferred embodiment of my invention a laminate assembly 10, FIG. 5, is formed into a hair curler 12 having a curler body 13, FIGS. 1-3, prior to activation and use. Laminate assembly 10 comprises a first sheet 18 which is formed of material impervious to liquids and has apertures 19 formed through its thickness and extending between first and second surfaces 20 and 21 respectively. Apertures 19 are arranged, as illustrated in FIG. 5, in a regular, rectangular array. The thickness of first sheet 18 is selected to provide the principle structural member of laminate assembly 10.

A liquid absorbing sheet 22 is provided having a thickness and first and second surfaces 23 and 24 respectively. Absorbent sheet 22 comprises, for example, a non-woven fabric formed of elongated, polymer fibers such as polypropylene. These fibers are irregularly extending in that the fibers have differing lengths. They have been treated with a wetting agent. One typical wetting agent is aerosol O.T. available from American Cyanamid of Wayne, New Jersey. The fibers are arranged so that the lengths of the fibers extend in a direction roughly parallel to each other to form a fabric grain. The irregularly extending fibers overlie each other forming pre-selected spaces or interstices therebetween and impart a texture to surfaces 23 and 24. The spacing between the fibers is selected on the basis of the surface tension forming characteristics of the activating fluid which initiates exothermic reaction. The thickness and surface area of absorbent sheet 22 is selected to provide for the absorption of a predetermined volume of an activating fluid. The fluid volume is retained in the interstices and held therein by the surface tension of the fluid.

Absorbent sheet 22 is co-extensive with first sheet 18. Second surface 21 of first sheet 18 is in intimate contact with relatively elevated areas of the textured first surface 23 of absorbent sheet 22. Relatively lower areas or valleys of textured first surface 23 form fluid channels interconnecting apertures 19. Absorbent sheet 22 exhibits a limited amount of resilience or give when subjected to a force applied to it in a direction perpendicular to the grain and is substantially nonresilient when subjected to a force applied to it in a direction parallel to the grain. Absorbent sheet 22 is arranged within laminate assembly 10 with the grain direction substantially perpendicular to the winding or forming direction of hair curler 12 as indicated by direction arrow 11 in FIG. 5. Upon winding or forming laminate assembly 10, the above-noted resiliency of absorbent sheet 22 is utilized to maintain intimate contact between surfaces 21 and 23.

Absorbent sheet 22 is treated in a plurality of limited areas with a hydrophobic material which coats the fabric fibers to form segments 26 in the limited areas to prevent wetting of the fibers therein. The treated segments provide fluid free interstices in absorbent sheet 22. Hydrophobic segments 26 are preferably established at locations an absorbent sheet 22 opposite apertures 19. An array of hydrophobic segments 26, as illustrated in FIG. 5, conform with the array of apertures 19 formed in first sheet 18. A suitable hydrophobic material comprises a flurochemical liquid repellent such as SCOTCHGARD available from the Minnesota Mining and Manufacturing Company.

A chemically reactive means 29 for generating an exothermic reaction is provided, as shown in FIG. 5, and comprises a mixture 30 of oxidizing material in granular form dispersed in a binder material and a reducing material comprising a sheet 28 having first and second surfaces 32 and 33. Mixture 30 is supported on second surface 24 of absorbent sheet 22 and is distributed on selected areas of surfaces 24 which are not contiguous with hydrophobic segments 26. Reducing sheet 28 is positioned with its first surface 32 in contact with mixture 30 and spaced from second surface 24 of absorbent sheet 22 by mixture 30. Reducing sheet 28 has a surface area selected for providing that its peripheral edges are relatively less in extent than absorbent sheet 22 of laminate assembly 10. The areas of contact between reducing sheet 28 and mixture 30 constitute chemical reaction sites wherein the exothermic reactions are initiated.

Various suitable chemically reactive materials are known in the art for providing the desired exothermic reaction. In a preferred arrangement, reducing sheet 28 is formed of a low density creped laminate aluminum foil available from the Dennison Manufacturing Company. The granular oxidizing material of mixture 30 comprises copper chloride, or staneous chloride, or a mixture of sodium nitrate and mecuric chloride. The binder material of mixture 30 comprises a water soluble adhesive such as LEPAGES mucilage or alternately a non-water based, water wettable adhesive such as ROYALDEX available from the Celanese Corporation. The liquid for activating the exothermic reaction of the chemically reactive means is water. The activating liquid dissolves the adhesive in mixture 30 to expose and activate the granular oxidizing material in mixture 30 at the reaction sites. In general, the quantity of oxidizing material and the thickness of the aluminum reducing sheet 28 are selected to provide an exothermic reaction which progresses at a predetermined rate in order to provide a predetermined level of heating in accordance with hair treating needs.

A second non perforated sheet 36 of liquid impervious material is provided comprising a relatively thin pliable film having a thickness for providing sufficient mechanical integrity to withstand ordinary rubbing and scuffing in usage. Second sheet 36 is positioned adjacent second surface 33 of reducing sheet 28 and extends coextensively with first sheet 18 and absorbent sheet 22. Second sheet 36 is sealed jointly with absorbent sheet 22 to first sheet 18 along peripheral edges 38 of laminate assembly 10 and assists in maintaining the aluminum foil reducing sheet 28 in position. The sealing of second sheet 36 to absorbent sheet 22 forms an enclosed space or chamber 40 therebetween. Chamber 40, so formed, encloses the reaction sites and provides for entrapment of particles which form as a result of the exothermic reaction. Since the size of these particles is greater than the interstices of absorbent sheet 22, subsequent leakage of the particles out of laminate assembly 10 is prevented. The hair curler laminate assembly of this invention is adapted to facilitate an exothermic reaction by automatically controlling the amount of activating fluid which is utilized for initiating and maintaining the reaction.

In use, laminate assembly 10 is formed into a hair roller such as hair curler 12 FIGS. 1–4. Hair curler 12 is preferably placed in a cup of activating fluid for a period of time to provide fluid saturation of absorbent sheet 22. Hair curler 12 is placed in the cup with either end of curler body 13 standing on the cup bottom, the depth of the fluid in the cup being sufficient to immerse at least three-fourths of body 13 in the fluid. With hair roller 12 so placed, the hydrostatic pressure of the fluid will enhance rapid saturation of absorbent sheet 22. It has been found that with the use of a non-woven fabric and the arrangement of the fabric fibers in the activating fluid, the hydrostatic pressure assists the capillary action or wicking of the fluid along the fibers for rapid saturation. In contrast, the saturation time of an equivalent woven fabric absorbent sheet proceeds at a relatively slower pace.

For absorbent sheet 22 of a given size and capable of absorbing a given volume of activating fluid at saturation, the minimum period of time required to saturate absorbent sheet 22 is determined by the rate at which the fluid flows through the apertures 19 and is absorbed by absorbent sheet 22. Since absorbent sheet 22 readily saturates, the flow time is primarily determined by the number of apertures and the area or size of each aperture. The total aperture area through which the fluid flows is selected to provide saturation within a conveniently short time period. Since the valleys of textured surface 23 interconnect apertures 19, the fluid readily flows past hydrophobic segments 26 aligned with apertures 19 into the fabric interstices. Saturation of absorbent sheet 22 occurs when the fluid fills the fabric interstices. Further ingress of the fluid is inhibited when a liquid barrier is formed at the interface of second surface 21 of first sheet 18 and textured surface 23 of absorbent sheet 22 due to the fluid surface tension established in the fabric interstices of this interface. Flooding of the reaction sites is thereby avoided. Due to this automatic control of the amount of activating fluid entering the reaction sites, there is no urgency in removing the hair curler assembly from the fluid upon saturation. Additionally, the size or area of aperture 19 is selected to prevent objects such as hairpins from entering through the apertures 19 to puncture absorbent sheet 22 which may lead to subsequent leakage of the products of the exothermic reaction from the laminated assembly.

The progression of exothermic reactions at the reaction sites requires a flow of gaseous products of reaction away from the sites. A gaseous flow passage for venting the gaseous products is provided by the fluid free interstices of hydrophobic segments 26 adjacent the reaction sites and through the apertures 19 aligned with hydrophobic segments 26. The use of the creped foil aluminum reducing sheet 28 enhances the venting of gaseous products by providing channels for the flow of gases from the reaction sites to hydrophobic segments 26. As a protection against inadvertent initiation of the reaction resulting from relatively high ambient humidity a coating of water soluable adhesive can be applied to first surface 32 of reducing sheet 28.

Referring now to FIGS. 1–4 hair curler 12 comprises laminate assembly 10 which is formed into curler body 13 having a length 14 and an arc-shaped transverse cross-sectional configuration. As previously mentioned, first sheet 18 provides the principle structural member of laminate assembly 10 and in the illustrated embodiment, the aforementioned material of first sheet 18 is selected to provide hair roller 12 with a body that is resiliently deflectable in a circumferential direction 15 and is substantially resistant to bending and buckling in other directions upon application of a finger force. Under finger force, curler body 13 is deflectable to various selectable diameters. A double sided tape 16 is provided for maintaining curler body 13 at a desired deflected diameter.

In forming curler body 13, laminate assembly 10 is positioned on a mandrel and is heated for imparting to laminate assembly 10 an elongated arc shape having the above-noted characteristics of body 13. Upon heat forming laminate assembly 10, absorbent sheet 22 is heat formed to conform with first sheet 18. First surface 23 of absorbent sheet 22 is drawn into intimate contact with the adjacent second surface 21 of first sheet 18 thereby preventing formation of undesirable air pockets between said surfaces. The formation of air pockets between these surfaces undesirably effects the formation of the liquid barrier and would lead to flooding of the reaction sites with activating liquid and a subsequent uncontrolled exothermic reaction.

In use, the curling of hair strands onto curler body 13 is enhanced if second non perforated sheet 36 is provided with a textured surface. To this end second sheet 36 is formed of sufficiently pliable material to conform closely to reducing sheet 28 imparting the creped texture of the aluminum foil to second sheet 36.

Figure 7:
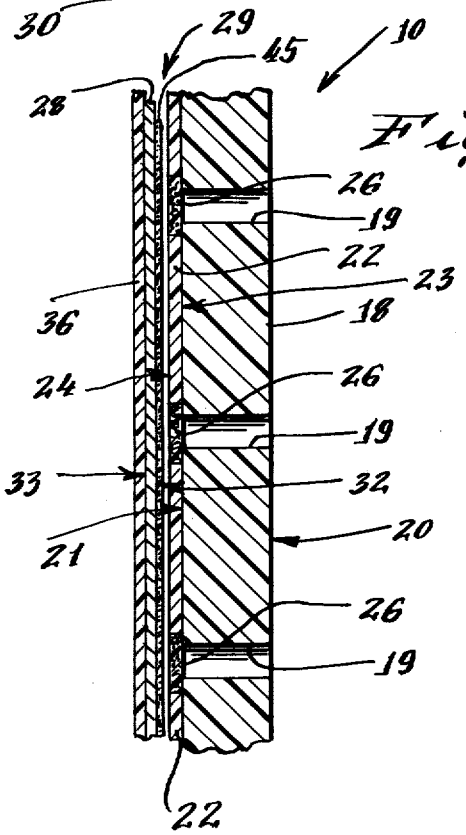
FIG. 7 is an enlarged, fragmentary view, in section of a cross-section of the hair curler of this invention prior to forming and illustrating an alternative embodiment of the invention.

There is illustrated in FIG. 7 an alternative embodiment of the invention which differs from the embodiment of FIGS. 4 and 6 in that chemically reactive means 29 comprises a mixture 45 applied uniformly to first surface 32 of aluminum reducing sheet 28 to provide therewith an assembly 46 of chemically reactive components. Mixture 45 comprises a granular oxidixing material and a non-water based, water soluable adhesive. The adhesive of mixture 45 can be used as a buffer to control the initiation time of the exothermic reaction as well as the rate of reaction by varying the soluability of the adhesive. This arrangement also operates to inhibit inadvertent initiation of the exothermic reaction due to relatively high levels of ambient humidity.

Figure 8:
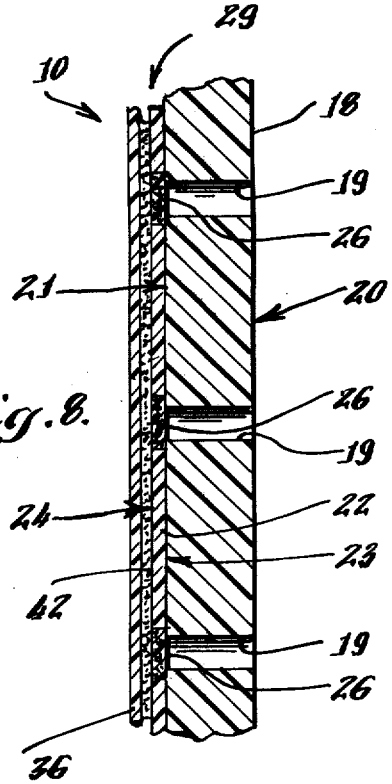
FIG. 8 is an enlarged, fragmentary cross-sectional view of the hair curler of this invention prior to forming and illustrating a still further embodiment of the invention.

In FIG. 8 another embodiment of the invention is illustrated wherein the aluminum reducing sheet 28 is eliminated and the chemically reactive means 29 comprises a mixture 42 of aluminum particles and granular oxidizing material in a binder material. This mixture 42 is uniformly positioned on second surface 24 of absorbent sheet 22.

Figure 9:
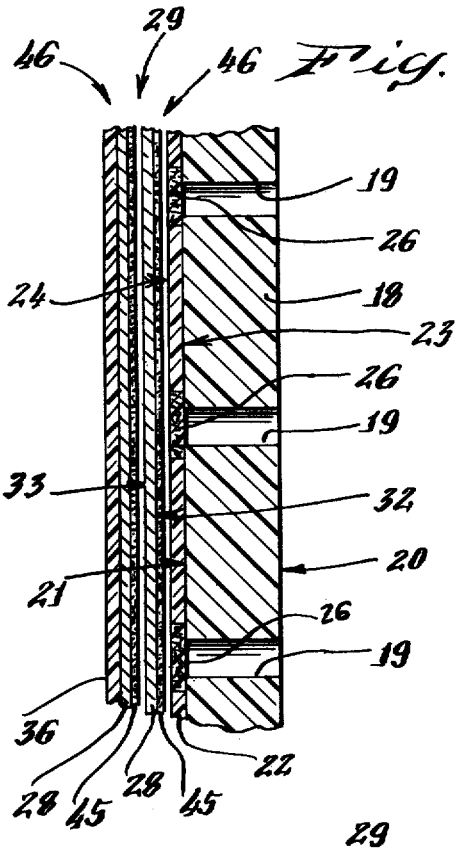
FIG. 9 is an enlarged fragmentary cross-sectional view of a further arrangement of the invention.

In a further embodiment shown in FIG. 9 a plurality of chemically reactive component assemblies 46 of the embodiment shown in FIG. 7 are provided. With this arrangement one of the component assemblies 46 is positioned adjacent second surface 24 of absorbent sheet 22 and reacts with the moisturizing fluid first. As it disintegrates during the reaction process the next component assembly 46 which is positioned adjacent second surface 33 of reducing sheet 28 of the above mentioned component assembly 46 is exposed to the activating fluid thereby initiating a second exothermic reaction to extend the heating of the curler within a predetermined range of time. Although only two assemblies of chemically reactive components are described any number of assemblies may be used limited by the desired flexibility of the laminate structure. The use of a plurality of chemically reactive component assemblies results in multiple temperature peaks as each assembly is exposed in turn to the activating fluid as the immediately preceeding assembly disintegrates. Thus a hair curler having an extended heating time period is provided. This type of hair curler is useful both for drying moistened hair and heat setting a desirable curl therein during the drying period.

An improved exothermic hair curler has thus been described which advantageously provides for entrapping of residue particles of a chemical reaction and which provides for the automatic absorption of a predetermined volume of activating liquid.

While particular embodiments of the invention have been described, it will be apparent to those skilled in the art that variations may be made thereto without departing from the spirit of the invention and the scope of the appended claims.

What is claimed is:

1. A laminated hair curler assembly comprising:

a. first sheet formed of a liquid impervious material and having a plurality of apertures formed in a thickness thereof;

b. a second non-perforated sheet formed of a liquid impervious material and sealed with said first sheet to provide an enclosure therebetween into which a reaction activating liquid can flow through said apertures;

c. a sheet of liquid absorbent material positioned between said first and second sheets;

d. means positioned between said absorbent sheet and said second sheet for creating an exothermic reaction when activated by a fluid in said enclosure;

e. means provided on said absorbent sheet for venting said exothermic reaction through said apertures; and f. said assembly formed into an elongated body having an arc-shaped cross-sectional configuration.

2. The hair curler of claim 1 wherein said first sheet and said second sheet extend substantially coextensively in surface area.

3. The hair curler of claim 2 wherein said first and second sheets are secured along edges thereof.

4. The hair curler of claim 3 wherein said first and second sheets are formed of a polymer and are heat sealed at said edges.

5. The hair curler of claim 4 wherein said absorbent sheet is coextensive in surface area with said first and second sheets, is formed of a polymer, and is heat sealed with said sheets along edges thereof.

6. The hair curler of claim 2 wherein said reaction means comprises a sheet of reactive material and a granular oxidizing material, said reactive sheet is positioned adjacent said second sheet and said granular material is positioned between said absorbent sheet and said reactive sheet.

7. The hair curler of claim 6 wherein said granular material is positioned at surface locations displaced from corresponding aperture locations on said first sheet.

8. The hair curler of claim 6 wherein said granular material is mounted on said absorbent sheet.

9. The hair curler of claim 8 including adhesive means for mounting said granular material to said absorbent sheet in contact with said reactive sheet.

10. A laminated curler assembly comprising:

a. a first sheet formed of a liquid impervious material and having an array of apertures formed in a thickness thereof and extending between first and second surfaces of said sheet;

b. a sheet of liquid absorbent material having first and second surfaces thereof, said first surface of said absorbent sheet positioned adjacent said second surface of said first sheet and secured thereto along peripheral edges of said sheets;

c. said absorbent sheet having hydrophobic areas positioned thereon which correspond in location with said apertures in said first sheet;

d. an oxidizing granular material positioned adjacent said second surface of said absorbent sheet at surface locations on said absorbent sheet displaced in location from apertures of said first sheet;

e. a sheet of reactive material positioned adjacent said oxidizing granular material;

f. a second sheet of liquid impervious material extending coextensively in surface area with said first sheet and secured thereto along a peripheral edge of said sheet.

11. The curler assembly of claim 10 wherein said assembly is formed into an elongated body having an arc-shaped configuration.

12. A laminated hair curling roller assembly including an elongated roller body having an arc-shaped transverse cross-sectional configuration, said body formed to provide substantial resistance to bending and buckling when subjected to finger force and said body comprising;

a. a first sheet of a thickness selected to provide the principle structural member for said roller body, said first sheet having a plurality of apertures formed therethrough;

b. a sheet of liquid absorbing material coextensive with said first sheet and positioned adjacent said first sheet;

c. a second non-perforated sheet of liquid impervious material coextensive with said first sheet and positioned adjacent said liquid absorbing sheet and spaced thereby from said first sheet, said second sheet sealed with the liquid absorbing sheet to said first sheet to form an enclosure therebetween;

d. means positioned between said second sheet and said liquid absorbing sheet for creating an exothermic reaction when activated by fluid absorbed by said absorbing sheet and entering said enclosure through the apertures formed in said first sheet; and e. means provided in said absorbing sheet for venting said exothermic reaction through said apertures formed in the first sheet.

13. The hair curling roller body of claim 12 wherein means for entrapment of particles which form as a result of exothermic reaction are provided within said enclosure.

14. The hair curling roller body of claim 13 wherein means for venting said enclosure are positioned on said liquid absorbing sheet in alignment with the apertures formed in said first sheet.

15. The hair curling roller body of claim 14 wherein said means for creating an exothermic reaction include a sheet of reactive material positioned in said enclosure between said liquid absorbing sheet and said second sheet and a granular oxidizing material positioned between said liquid absorbent sheet and said sheet of reactive material.

16. The hair curling roller body of claim 15 wherein said means for creating an exothermic reaction include a mixture of oxidizing material comprising said granular oxidizing material dispensed in a binder material.

17. The hair curling roller body of claim 14 wherein said means for creating an exothermic reaction comprise a mixture of granular reactive material and granular oxidizing material dispersed in a binder material and said mixture is uniformly distributed on the surface of said liquid absorbing sheet adjacent said second sheet.

18. The hair curling roller body of claim 17 wherein said reactive material comprises aluminum particles and said binder material comprises a water soluble adhesive.

19. The haircurling roller body of claim 16 wherein said mixture is supported on and distributed over selected areas of the surface of said liquid absorbing sheet, said selected areas being non-contiguous with said venting means.

20. The hair curling roller body of claim 19 wherein said sheet of reactive material has surface areas in contact with said mixture on said selected surface areas of the liquid absorbing sheet and the surface of said reactive sheet is spaced from the surface of said liquid absorbing sheet by said areas of contact.

21. The hair curling body of claim 20 wherein said binder material comprises a water soluble adhesive.

22. The hair curling body of claim 16 wherein said mixture is deposited uniformly on the surface of said sheet of reactive material adjacent said liquid absorbing sheet.

23. The hair curling body of claim 22 wherein said sheet of reactive material and said uniformly deposited mixture comprise a chemically reactive component assembly and said hair curling body includes a plurality of said reactive component assemblies to provide extended heating of the body within a predetermined range of time having multiple temperature peaks within said range of time.

24. The hair curling body of claim 23 wherein said binder includes a non-water based water soluble adhesive.

25. A laminated hair curling roller assembly including an elongated roller body having an arc-shaped transverse cross-sectional configuration, said body formed to provide substantial resistance to bending and buckling when subjected to finger force and said body comprising;

a. a first sheet of a thickness selected to provide the principle structural member for said roller body, said first sheet having a plurality of apertures formed therethrough;

b. a sheet of liquid absorbing material co-extensive with said first sheet and positioned adjacent said first sheet;

c. a second sheet of liquid impervious material co-extensive with said first sheet and said liquid absorbing sheet and positioned adjacent said liquid absorbing sheet and spaced thereby from said first sheet, said second sheet sealed with the liquid absorbing sheet to said first sheet to form an enclosure therebetween;

d. means positioned between said second sheet and said liquid absorbing sheet for creating an exothermic reaction when activated by fluid absorbed by said absorbing sheet and entering said enclosure through the apertures formed in said first sheet;

e. means provided within said enclosure for entrapment of particles which form as a result of exothermic reaction; and f. means positioned on said liquid absorbing sheet in alignment with said apertures for venting said enclosure and including a plurality of areas on said absorbing sheet treated with a hydrophobic material to form non-liquid absorbing segments in said absorbing sheet.

26. The hair curling roller body of claim 25 wherein said liquid absorbing sheet is of a preselected thickness and surface area comprising a non-woven fabric formed of irregularly extending fibers arranged in overlying relationship to form preselected interstices therebetween and treated with a wetting agent, said interstices selected on the basis of surface tension forming characteristics of an activating fluid for initiating said exothermic reaction and wherein said thickness and surface area provides for the absorption of a predetermined volume of activating fluid held in said interstices by the surface tension of the fluid.

27. The hair curling roller body of claim 26 wherein said non-liquid absorbing segments provide fluid free interstices in said liquid absorbing sheet.

28. The hair curling roller body of claim 27 wherein said means for entrapment of particles include said interstices formed in said liquid absorbing sheet.

29. A laminated hair curler assembly comprising;

a. a first sheet formed of a liquid impervious material and having a plurality of apertures formed in a thickness thereof;

b. a second sheet formed of a liquid impervious material having a surface area extending substantially coextensively with the surface area of the first sheet and sealed with said first sheet to provide an enclosure therebetween into which a reaction activating liquid can flow through said apertures;

c. a sheet of liquid absorbent material positioned between said first and second sheets and including hydrophobic segments positioned adjacent said apertures of the first sheet;

d. means positioned between said absorbent sheet and said second sheet for creating an exothermic reaction when activated by a fluid in said enclosure; and e. said assembly formed into an elongated body having an arc-shaped cross-sectional configuration.

30. The hair curler of claim 29 wherein said hydrophobic segments are provided by a hydrophobic material deposited on said absorbent sheet.

* * * * *